US009059520B2

(12) United States Patent
Bungo

(10) Patent No.: US 9,059,520 B2
(45) Date of Patent: Jun. 16, 2015

(54) WIRELESS COMMUNICATION DEVICE AND COMMUNICATION TERMINAL APPARATUS

(71) Applicant: SONY MOBILE COMMUNICATIONS JAPAN, INC., Tokyo (JP)

(72) Inventor: Akihiro Bungo, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 258 days.

(21) Appl. No.: 13/713,099

(22) Filed: Dec. 13, 2012

(65) Prior Publication Data

US 2013/0194143 A1 Aug. 1, 2013

Related U.S. Application Data

(60) Provisional application No. 61/592,889, filed on Jan. 31, 2012.

(51) Int. Cl.

| | |
|---|---|
| ***H01Q 21/00*** | (2006.01) |
| ***H01Q 21/28*** | (2006.01) |
| ***H01Q 1/24*** | (2006.01) |
| ***H01Q 9/04*** | (2006.01) |

(52) U.S. Cl.

CPC ..... *H01Q 21/28* (2013.01); *H01Q 1/243* (2013.01); *H01Q 9/0421* (2013.01); *H01Q 9/0435* (2013.01); *H01Q 9/0442* (2013.01)

(58) Field of Classification Search

CPC ..... H01Q 21/28
USPC ..... 343/725, 767, 769, 702, 745; 455/77, 455/73, 90.3
See application file for complete search history.

(56) References Cited

U.S. PATENT DOCUMENTS

| | | | | |
|---|---|---|---|---|
| 7,034,762 | B2 * | 4/2006 | Huang | 343/767 |
| 8,054,231 | B2 * | 11/2011 | Ahn et al. | 343/702 |
| 8,638,265 | B2 * | 1/2014 | Mahanfar | 343/767 |
| 8,798,554 | B2 * | 8/2014 | Darnell et al. | 455/77 |
| 2001/0007445 | A1 | 7/2001 | Pankinaho | |
| 2003/0193437 | A1 | 10/2003 | Kangasvieri et al. | |
| 2009/0231215 | A1 | 9/2009 | Taura | |
| 2011/0254741 | A1 * | 10/2011 | Ishimiya | 343/702 |
| 2011/0254749 | A1 | 10/2011 | Amari et al. | |

FOREIGN PATENT DOCUMENTS

| | | |
|---|---|---|
| JP | 2008-017047 | 1/2008 |

OTHER PUBLICATIONS

U.S. Appl. No. 13/541,162, filed Jul. 3, 2012, Bungo.
The Extended European Search Report issued May 7, 2013, in Application No. / Patent No. 12198943.8-1812.

* cited by examiner

*Primary Examiner* — Huedung Mancuso
(74) *Attorney, Agent, or Firm* — Oblon, McClelland, Maier & Neustadt, L.L.P.

(57) ABSTRACT

A communication terminal apparatus and wireless communication device include comprising a first antenna having a first feed point, and a second antenna including a slit antenna and having a second feed point, the second antenna being spaced apart from the first antenna. The slit antenna includes a first conductive plate, a second conductive plate disposed substantially parallel to the first conductive plate, and a short-circuiting structure electrically connected between the first conductive plate and the second conductive plate so as to electrically short the first conductive plate to the second conductive plate.

17 Claims, 19 Drawing Sheets

WIRELESS COMMUNICATION DEVICE AND COMMUNICATION TERMINAL APPARATUS

CROSS REFERENCE TO RELATED APPLICATIONS

The present application is based upon and claims the benefit of priority from U.S. Application No. 61/592,889, filed Jan. 31, 2012, the entire contents of which are incorporated herein by reference.

TECHNICAL FIELD

The present invention relates to a wireless communication device and communication terminal apparatus, such as a MIMO (multi-input multi-output) antenna device, that uses first and second antenna devices.

BACKGROUND ART

A service called long term evolution (LTE) is known as one of the high-speed data communication specifications for mobile telephones. From the technical viewpoint of the antenna, the LTE has the following features.

That is, the LTE, which is a communication system called MIMO, achieves high-speed data communication by using a plurality of antennas in transmission and reception. A wireless communication device such as a mobile terminal using MIMO usually employs two antennas. Ideally, it is required that the antenna characteristics of the two antennas be equivalent.

As for the antenna characteristics of a MIMO antenna device, an index called antenna correlation is a key point. It is known that when a value (coefficient) of the antenna correlation is high (that is, the level of correlation is high), the communication speed is lowered.

PTL 1 proposes a multi-antenna applicable to a mobile communication system that is less affected by mutual coupling. This multi-antenna has a plurality of feed elements connected to a plurality of feed points on a circuit board and also has a single parasitic element or a plurality of parasitic elements connected to the circuit board in the vicinity of arbitrary feed points.

CITATION LIST

Patent Literature

[PTL 1] Japanese Unexamined Patent Application Publication No. 2008-17047

SUMMARY OF INVENTION

Frequency bands used in LTE services that are currently provided or will be provided in individual countries spread in a wide range, so it is desired that both the low bands and high bands of existing solar systems be expanded.

In a service in the 700-MHz band in the U.S.A, for example, it is extremely difficult to lower the antenna correlation. This is because when the frequency is low, a high-frequency current flows in the entire circuit board of the mobile terminal and an operation mode as with a dipole is thereby entered, so the directivity of the antenna does not so depend on the antenna design. Accordingly, even if an attempt is made to improve correlation by changing the design of one antenna to change its directivity, a desired result cannot be easily obtained.

In this background, the inventor recognizes the need for a wireless communication device having an antenna device that achieves a low level of correlation among a plurality of antennas.

According to an embodiment of the present invention, a communication terminal apparatus is provided that includes a first antenna having a first feed point; and a second antenna including a slit antenna and having a second feed point, the second antenna being spaced apart from the first antenna, wherein the slit antenna includes a first conductive plate, a second conductive plate disposed substantially parallel to the first conductive plate, and a short-circuiting structure electrically connected between the first conductive plate and the second conductive plate so as to electrically short the first conductive plate to the second conductive plate.

According to one aspect of the embodiment, the slit antenna is formed by part of an outer end of the first conductive plate and part of an outer end of the second conductive plate, the part of the outer end of the first conductive plate and the part of the outer end of the second conductive plate face each other.

According to another aspect of the embodiment the first conductive plate is part of a conductive case panel.

According to another aspect of the embodiment the second conductive plate is a conductive layer of a printed circuit board.

According to another aspect of the embodiment the second conductive plate is a metal plate that is positioned substantially parallel to the first conductive plate of the case panel.

According to another aspect of the embodiment the short circuiting structure includes a plurality of conductive contact members.

According to another aspect of the embodiment the plurality of conductive contact members are disposed between the first conductive plate and the second conductive plate and spaced outside a slit portion of the slit antenna and at intervals smaller than a predetermined interval along respective outer ends of the first conductive plate and the second conductive plates, said predetermined interval being set so that a resonance frequency of the slit antenna is higher than a communications frequency used by said communications terminal apparatus.

According to another aspect of the embodiment the first antenna is an inverted F-type antenna that includes a feed element and a short-circuiting member that electrically shorts a position on the feed element spaced apart from the first feed point to the first conductive plate.

According to another aspect of the embodiment the first antenna and the second antenna are parts of a MIMO antenna device.

A wireless comminations device embodiment is also provided that has antenna features like those described above.

DESCRIPTION OF EMBODIMENTS

An embodiment of the present invention will be described in detail with reference to the drawings.

Figure 1A:
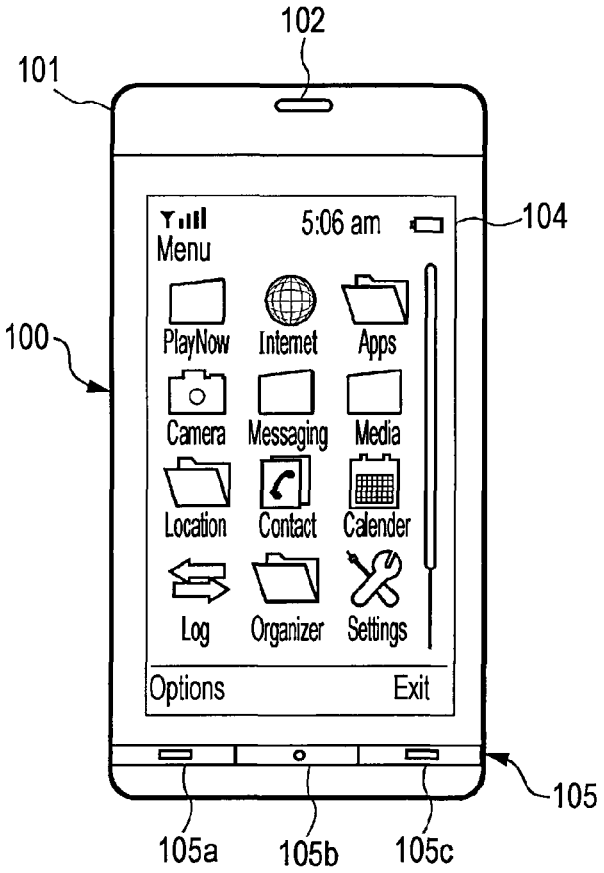
FIGS. 1(*a*) and 1(*b*) respectively illustrate the appearances of the front surface and rear surface of a mobile terminal.
Figure 1B:
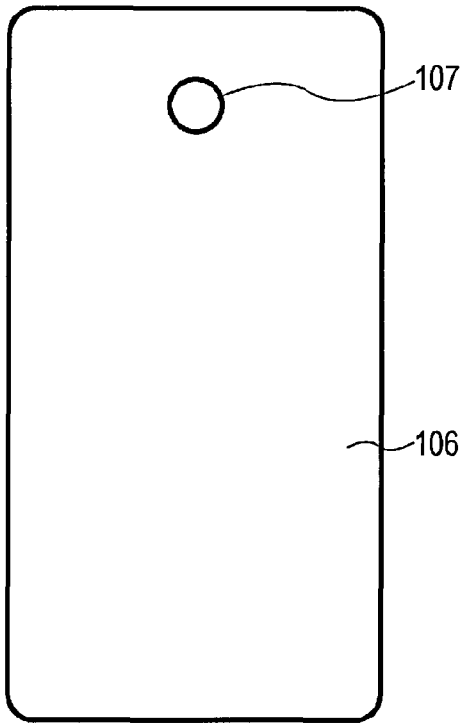

FIGS. 1(*a*) and 1(*b*) respectively illustrate the appearances of the front surface and rear surface of a mobile terminal called, for example, a smart phone as an example of a wireless communication device in this embodiment. This mobile terminal has a case 101, the outer shape of which is substantially a rectangular parallelepiped.

A display screen 104 of a display device such as, for example, an LCD is exposed on the front side of the mobile terminal illustrated in FIG. 1(*a*). A speaker part 102 is provided on the upper side of the display screen 104, and a manipulation part 105 including manipulation keys 105*a* to 105*c* is placed on the lower side of the display screen 104.

As well illustrated in FIG. 1(*b*), in this example, a conductive case panel 106 is placed on the entire rear surface of the mobile terminal. The case panel 106 forms a first conductive plate, which will be described later. The case panel 106 doubles as a battery lid, but it does not necessarily double as a battery lid. In this example, the case panel 106 is formed with a conductive metal material. Instead of this, the case panel 106 may be formed by covering a plastic material with conductive layers or incorporating a plastic material into a conductive layer. The circular opening formed at the center of the upper portion of the case panel 106 indicates a camera part 107. In the present invention, however, the camera part 107 is not a requisite element. The mobile terminal includes a main antenna, which is a first antenna, at the bottom, and also includes a sub-antenna, which is a second antenna, placed at the top at a distance from the main antenna. The first antenna and second antenna are antennas the principles of operation of which differ.

Figure 2:
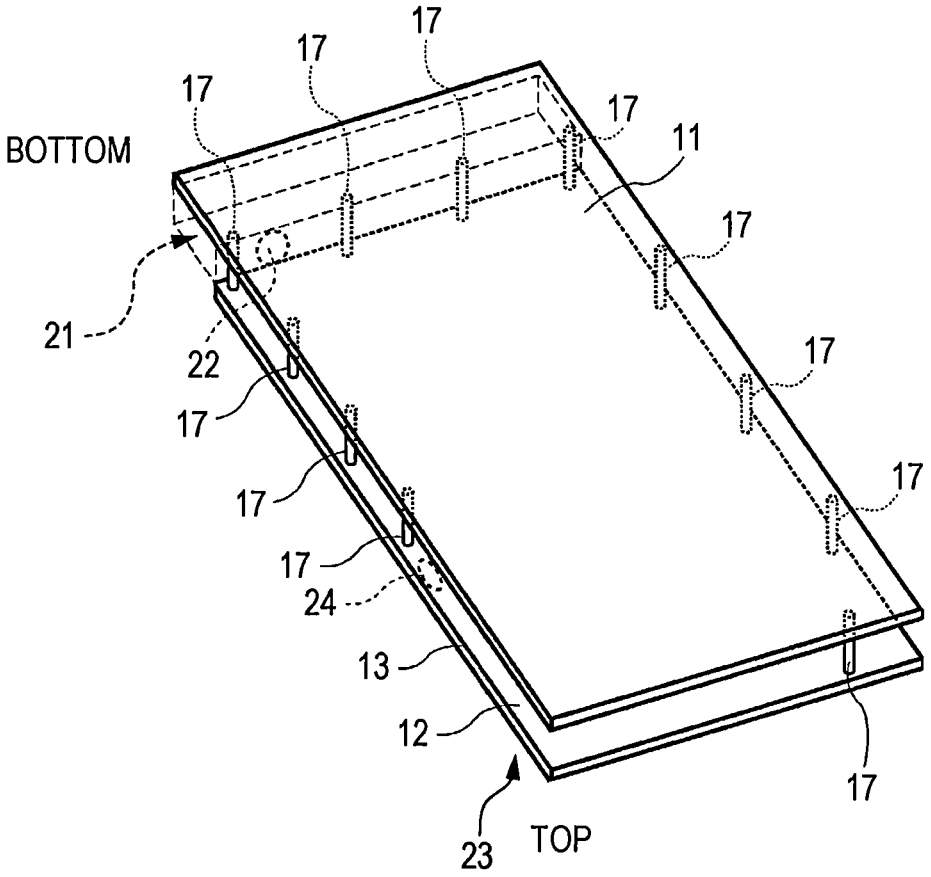
FIG. 2 is a perspective view schematically illustrating the structure of the antenna device of the mobile terminal in an embodiment of the present invention.

FIG. 2 is a perspective view schematically illustrating the structure of the antenna device of the mobile terminal in this embodiment. For the sake of convenience, the top of the mobile terminal is indicated on the lower side of the drawing. This mobile terminal has an antenna 21, which is the first antenna, at the bottom and also has an antenna 23, which is the second antenna, placed at the top at a distance from the antenna 21. In this embodiment, the antenna 21 and antenna 23 form a MIMO antenna device. The antenna 21 has a feed element, described later, and a first feed point 22 at which the feed element is powered.

A first conductive plate 11 extends substantially over the entire rear surface of the mobile terminal. A second conductive plate 13 extends substantially parallel to the first conductive plate 11. The conductive plate 11 and conductive plate 13 are electrically connected to each other by a plurality of short-circuiting members 17 along their outer ends excluding the range of a slit 12 described later. Although a conductive pin is assumed here to be the short-circuiting member 17, there is no limitation to its shape and size. A conductive contact member such as a plate-like conductive member or conductive spring may be used. Alternatively, a spring structure may be provided on the same side as the case panel 106, or a leaf spring may be provided on the same side as an oppositely disposed member. A slit antenna including the slit 12, which is formed with the conductive plate 11 and conductive plate 13, is structured as the second antenna 23. With this slit antenna, electric power is supplied between the two conductive plates at a feed point 24 (second feed point) slightly separated toward the inside of the slit from an end of the slit 12 on a side of the mobile terminal.

The second conductive plate 13 also functions as the ground plane of the antenna 21.

Figure 3A:
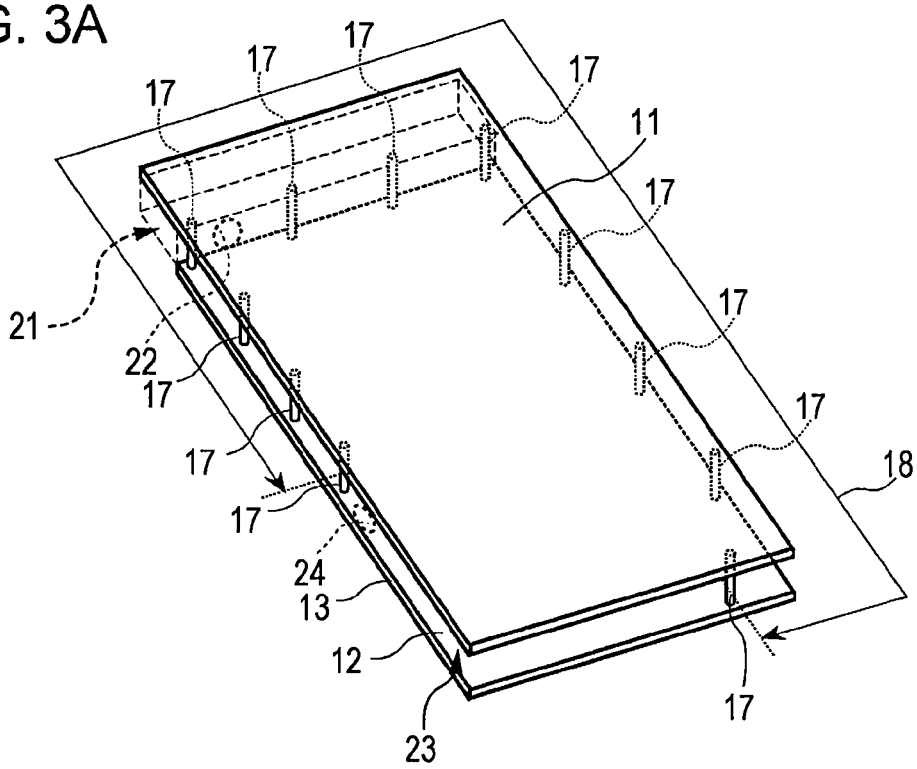
FIG. 3(*a*) illustrates the two conductive plates extracted from FIG. 2 and FIG. 3(*b*) illustrates a structure equivalent to the structure in FIG. 2.
Figure 3B:
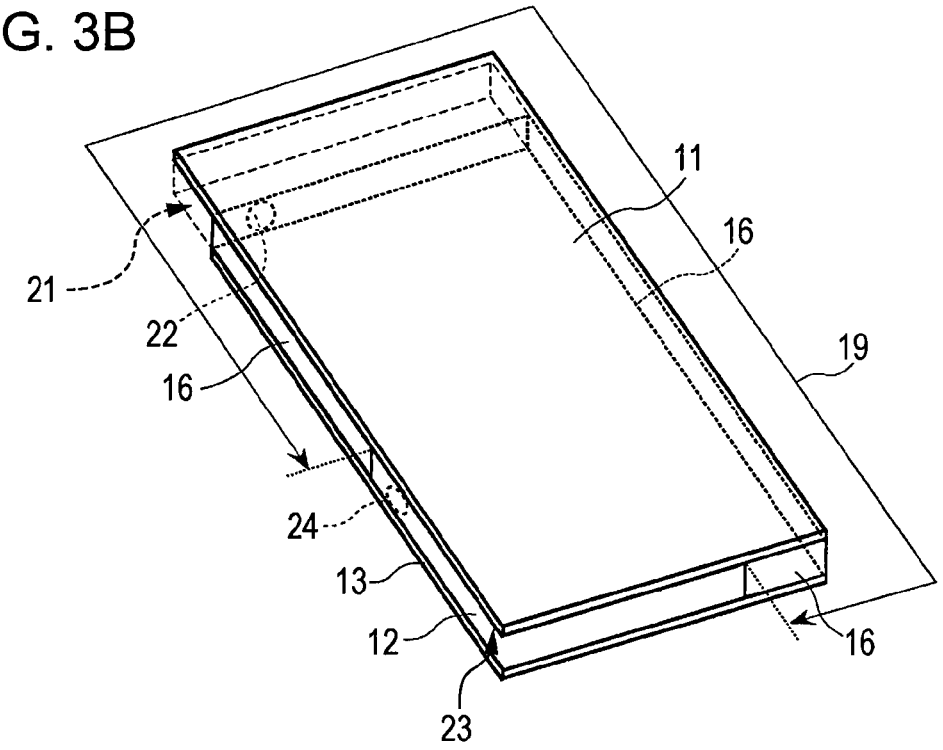

FIG. 3(*a*) illustrates the conductive plates 11 and 13 extracted from FIG. 2. The short-circuiting members 17 are placed at both ends of a prescribed range 18 (which excludes the area of the second antenna 23) and at a plurality of substantially equally spaced positions between the ends. The interval between adjacent short-circuiting members 17 is smaller than a prescribed value so that the resonance frequency of the slit antenna formed with the slit having the interval becomes adequately higher than a frequency used by the mobile terminal. When the short-circuiting member 17 is a conductive pin, for example, a plurality of conductive pins are placed at intervals smaller than a prescribed interval along the outer ends of the first and second conductive plates outside the area of a target slit. As for the frequency used, this structure can be assumed to be equivalent to a structure in which the range 18 of the outer ends of the two conductive plates is entirely covered with a solid conductive plate (plate-like member) 16, as illustrated in FIG. 3(*b*). As a result, the slit 12 is formed by a clearance between the two conductive plates 11 and 13 in a range 19 of the outer ends of the two conductive plates. In other words, the short-circuiting members 17 electrically short-circuit between the first conductive plate and second conductive plate so that a prescribed slit is formed by part of the outer end of the first conductive plate and part of the outer end of the second conductive plate, these parts facing each other. This structure can be assumed to be a slit antenna in which a prescribed slit is formed in a single conductive plate as described later with reference to FIG. 4(*a*). The length of the slit is set so that the length closely matches the half-wave length (λ/2) of the frequency of the antenna device used in the mobile terminal. The width of the slit 12 may not be constant over the entire length in its longitudinal direction.

Figure 4A:
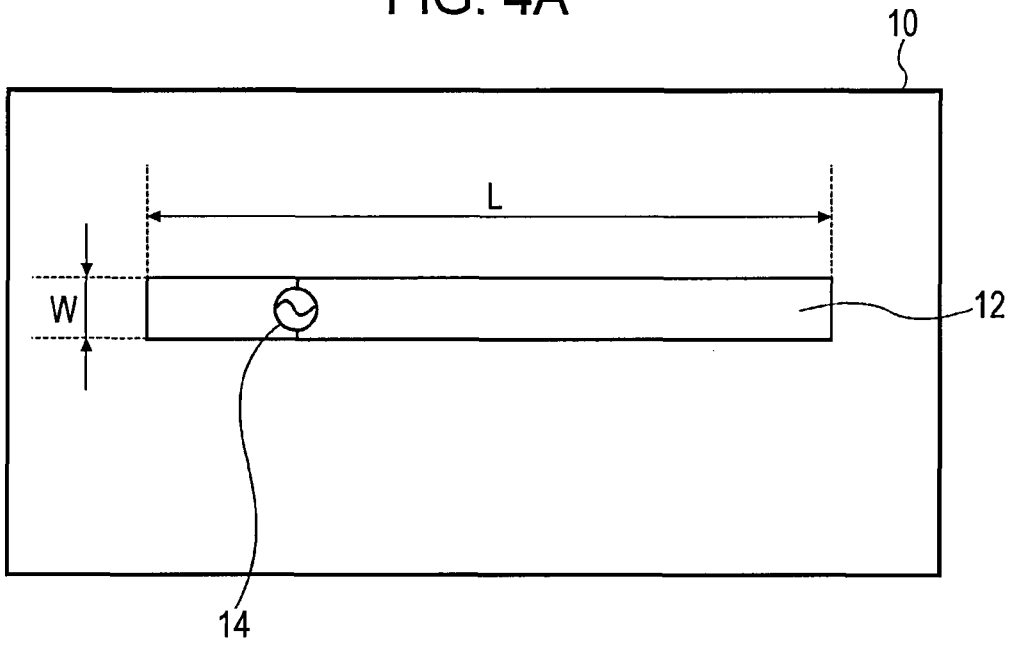
FIGS. 4(*a*) and 4(*b*) are drawing used to explain a known slit antenna (or a slot antenna).
Figure 4B:
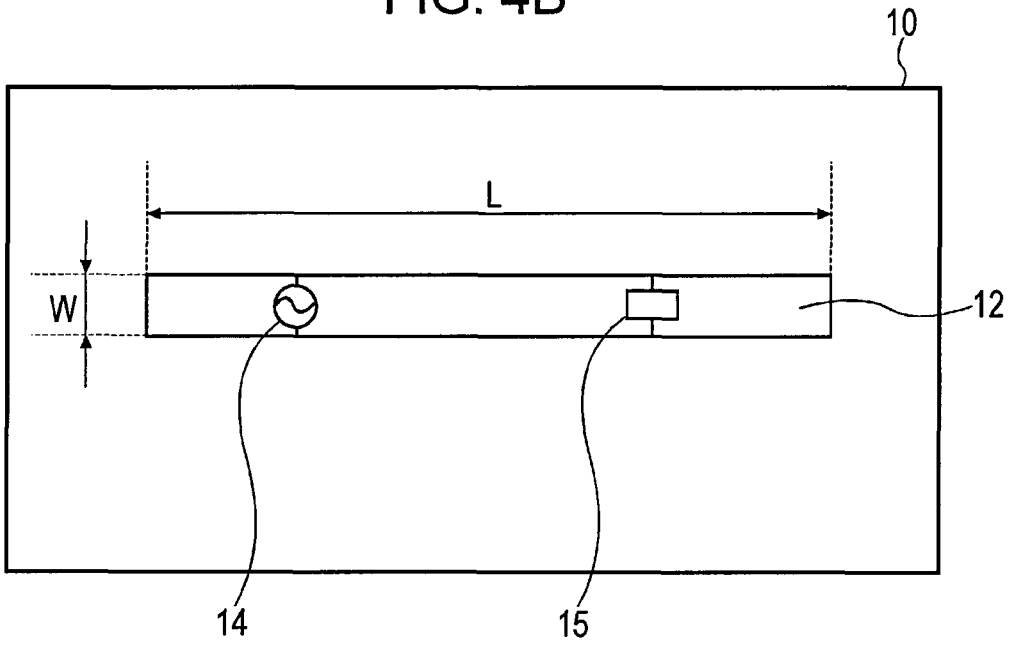

For a better understanding of this embodiment, a known slit antenna (or slot antenna) will be described with reference to FIGS. 4(*a*) and 4(*b*). As illustrated in FIG. 4(*a*), an elongated slit (or slot) 12 is formed in a conductor plate 10, and an alternating voltage with a frequency a half-wave length of which is equal to the slit length is applied across two edges of the slit 12. It is known that an electromagnetic filed is thereby generated from the conductor plate 10, and the conductor plate 10 functions as an antenna. The resonance frequency of the slit antenna depends on the length L of the slit 12. The width W of the slit 12 can also affect the resonance frequency. As illustrated in FIG. 4(*b*), when an element 15, which is an electronic part, is inserted between the two edges, the resonance frequency of the slit antenna can be adjusted. In this example, the element 15 is a passive element, which is, for example, an inductor having an inductive reactance or a reactive element such as a capacitor having a capacitive reactance. The resonance frequency of the slit antenna can be increased by an inductor and can be lowered by a capacitor.

Figure 5:
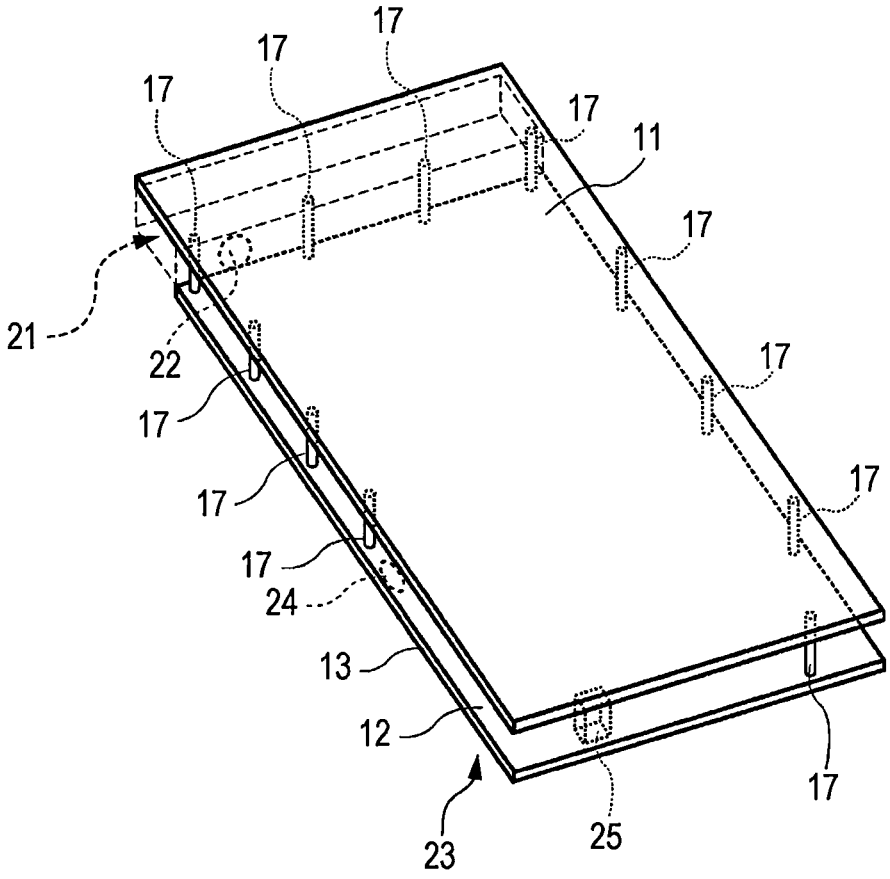
FIG. 5 illustrates a structure in which a reactive element is connected at an intermediate position in the longitudinal direction of the slit.

In the structures illustrated in FIG. 3 as well, an element 25 used as an inductor or a reactive element such as a capacitor can also be connected between the opposing edges of the slit 12 at an intermediate position in the longitudinal direction of the slit 12, as illustrated in FIG. 5. When a value is selected for this type of element, the resonance frequency of the slit antenna with the slit 12 can be adjusted as described in FIG. 4(*b*). In the present invention, however, the use of this type of element 25 is not requisite.

Figure 6:
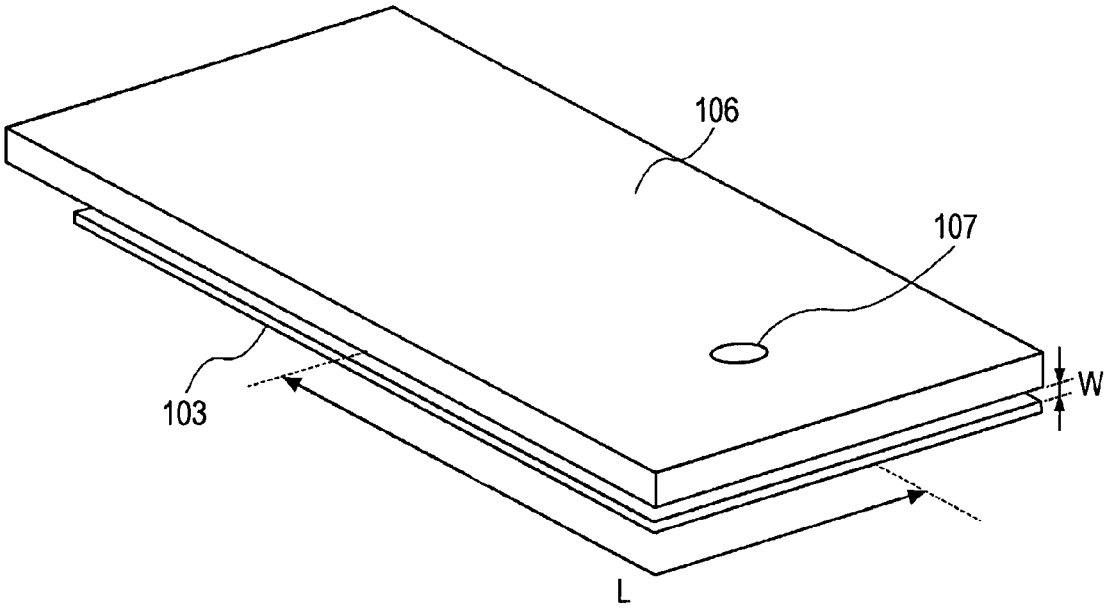
FIG. 6 is a drawing used to illustrate the slit width W of a slit antenna formed with a case panel in the embodiment of the present invention and another conductive plate and a change in the antenna characteristics of the slit antenna.
Figure 7:
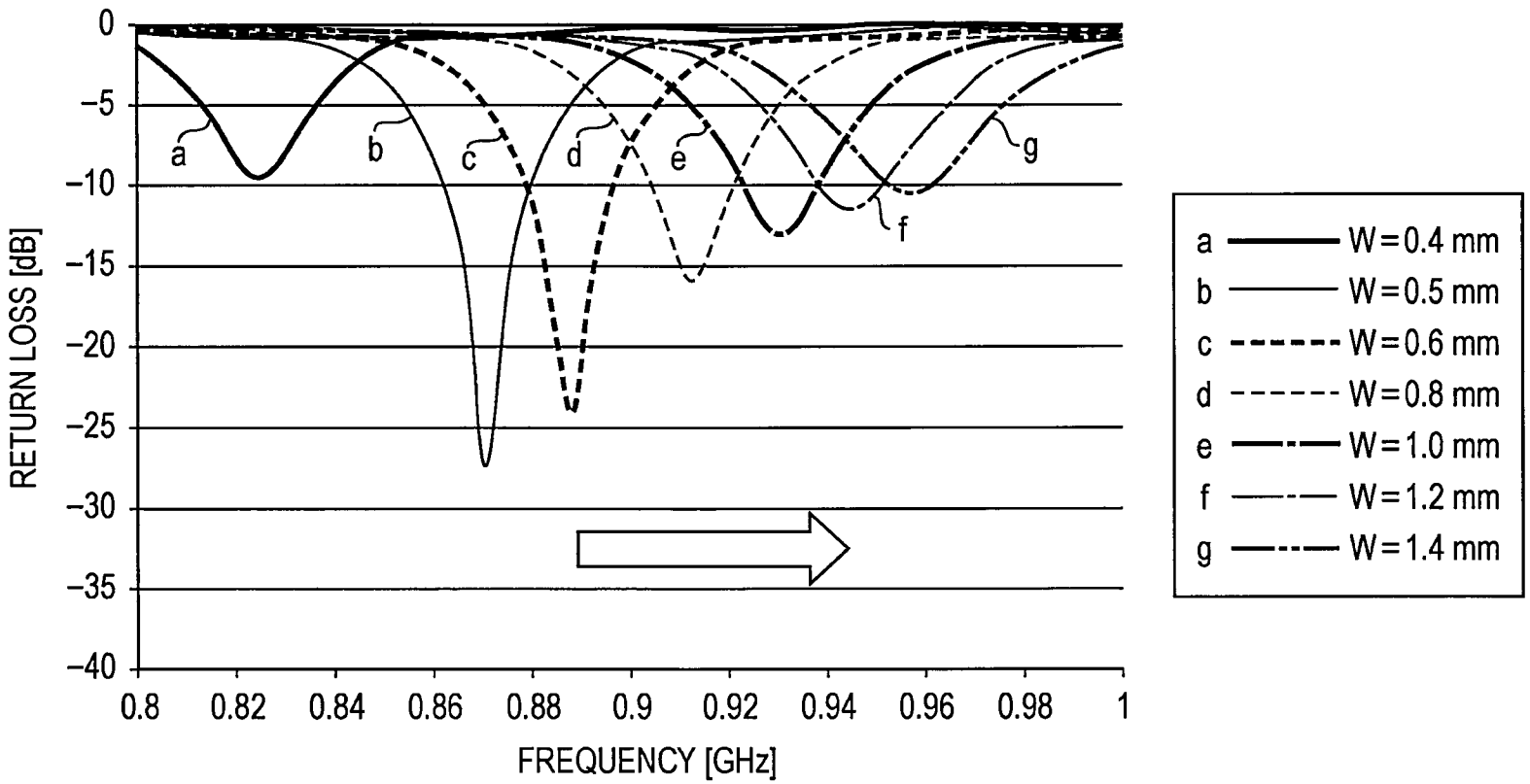
FIG. 7 is a graph representing the frequency characteristics of the slit antenna when the slit length L is fixed and the slit width W is changed.

A consideration will be given to the slit width W of a slit antenna formed with the case panel 106 in this embodiment and another conductive plate 103 and to a change in the antenna characteristics of the slit antenna, with reference to FIG. 6. FIG. 7 illustrates a graph representing the frequency characteristics of the slit antenna when the slit length L is fixed and the slit width W is changed. The vertical axis of the graph indicates return loss [dB] and the horizontal axis indicates frequency [GHz]. Waveforms "a" to "g" respectively represent changes in return loss when the slit width W (mm) is 0.4, 0.5, 0.6, 0.8, 1.0, 1.2, and 1.4. The graph is based on results obtained through simulation. This is also true for other graphs described later. It is found from these graphs that the resonance frequency of the slit antenna is shifted toward the high frequency side as the slit width W becomes larger.

As for the frequency characteristics of the slit antenna when the slit length L is fixed and the slit width W is changed, although not illustrated, the resonance frequency can be thought to shift to the low frequency side as the slit L becomes longer.

Figure 8A:
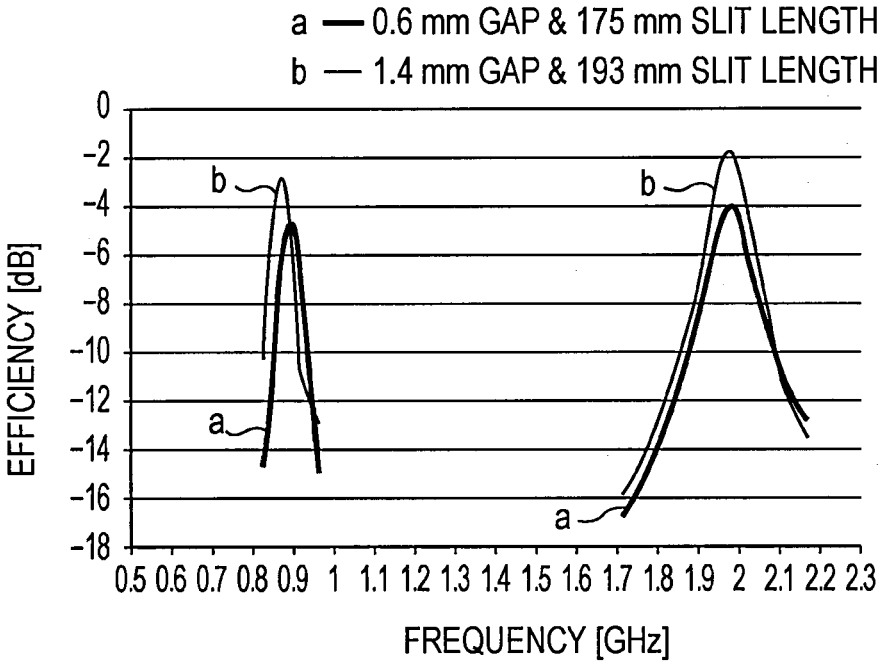
FIGS. 8(*a*) and 8(*b*) are drawings used to illustrate the slit width of the slit antenna and the antenna efficiency.
Figure 8B:
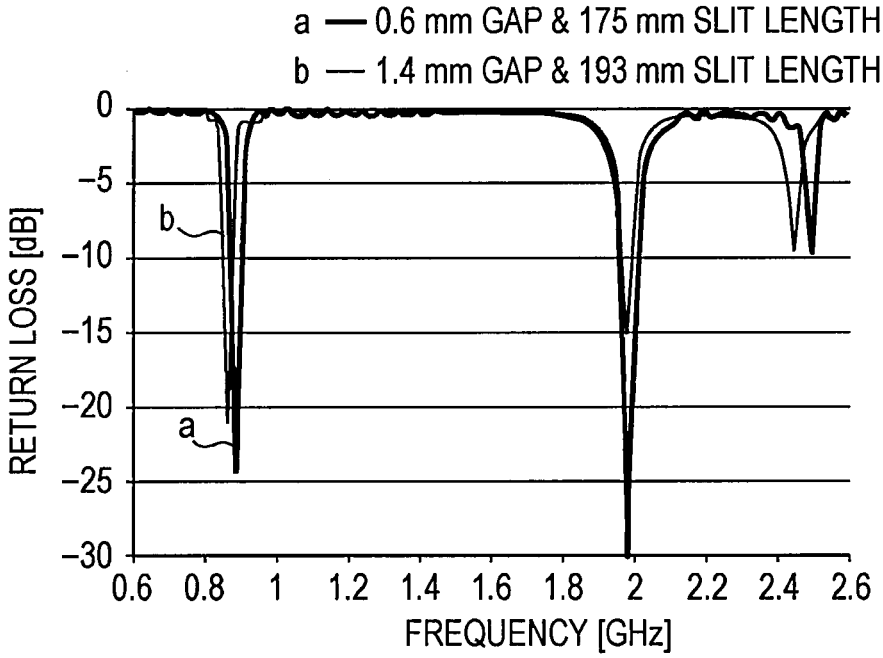

The slit width of the slit antenna and the antenna efficiency will be described with reference to FIGS. 8(*a*) and 8(*b*). A case is assumed in which, after the slit width W of the slot antenna has been increased from 0.6 mm to 1.4 mm, the resonance frequency is set to a fixed value by adjusting the slit length L (increasing from 175 mm to 193 mm, in this example). FIG. 8(*b*) illustrates a graph representing frequency characteristics (return loss) before and after the size of this type of slit antenna is changed. It is found from this graph that there is a match in the resonance frequency before and after the size of the slit antenna is changed. FIG. 8(*a*) illustrates a graph representing frequency characteristics of the antenna efficiency before and after the size of this type of slit antenna is changed. It is found from this graph that, when the slit width W is increased with the resonant frequency unchanged, the antenna efficiency is increased.

Figure 9A:
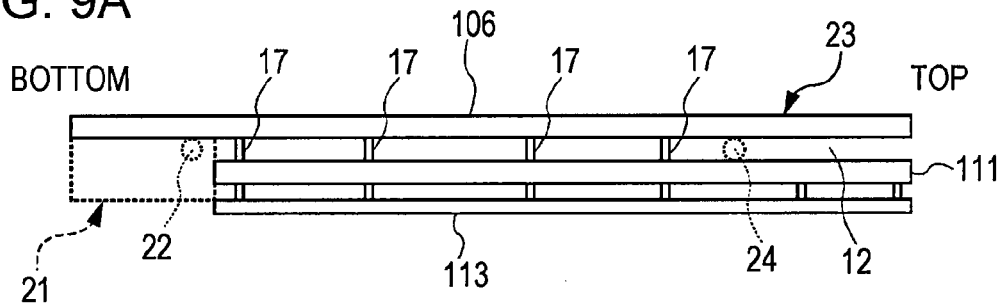
FIGS. 9(*a*) to 9(*c*) illustrate some main aspects as combinations of elements constituting the slit in the embodiment of the present invention.
Figure 9B:
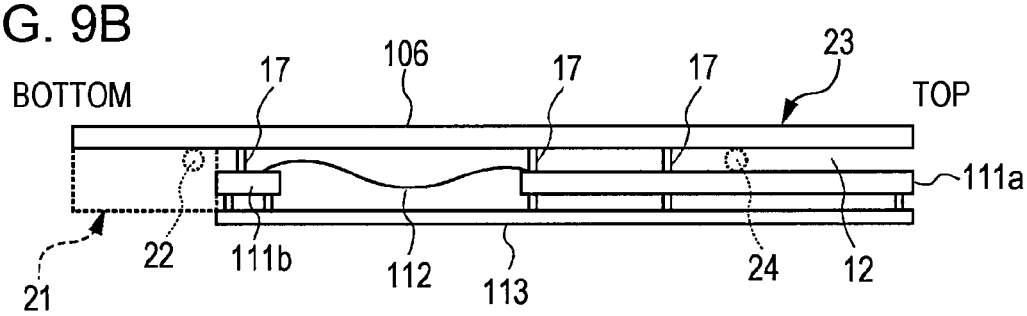
Figure 9C:
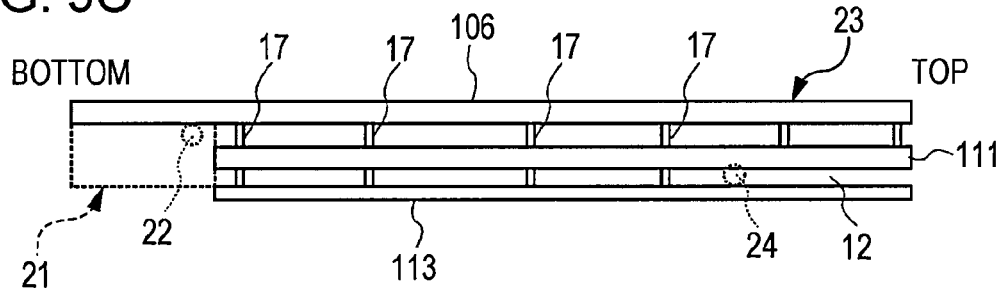

FIGS. 9(*a*) to 9(*c*) illustrate some main aspects as combinations of elements constituting the slit 12 in this embodiment.

FIG. 9(*a*) illustrates a first aspect in which the case panel 106 having conductivity as described above is used as the first conductive plate and a conductive layer (GND plane) formed on a printed circuit board (PCB) 111 is used as the second conductive plate.

FIG. 9(*b*) illustrates a second aspect in which the case panel 106 having conductivity is used as the first conductive plate and conductive layers (GND planes) formed on a first PCB 111*a* and a second PCB 111*b*, which are two divided boards, are used as the second conductive plate. The conductive layers on the two PCBs 111*a* and 111*b* are mutually connected with a conductive linking member 112. The conductive linking member 112 can be formed with, for example, a coaxial cable. In this second aspect, the PCBs 111 and a SUS plate 113 are grounded together.

FIG. 9(*c*) illustrates a third aspect in which the case panel 106 having conductivity is used as the first conductive plate and the SUS plate 113 is used as the second conductive plate. The SUS plate 113 is a metal plate formed of steel use stainless, which is generally used to, for example, reinforce the LCD panel of a mobile terminal. The SUS plate 113 is placed substantially parallel to the case panel. In this third aspect, the case panel 106 and PCB 111 are grounded together, and the slit 12 is formed in practice between the PCB 111 and the SUS plate 113.

Figure 10A:
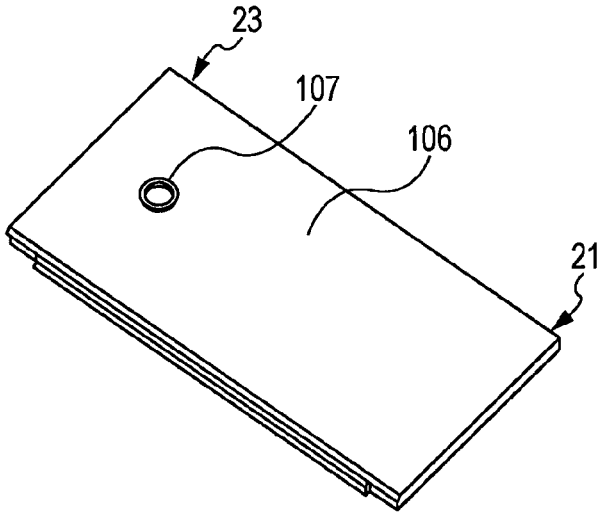
FIGS. 10(*a*) to 10(*c*) are perspective views schematically illustrating the appearance of the mobile terminal in the second aspect illustrated in FIG. 9.
Figure 10B:
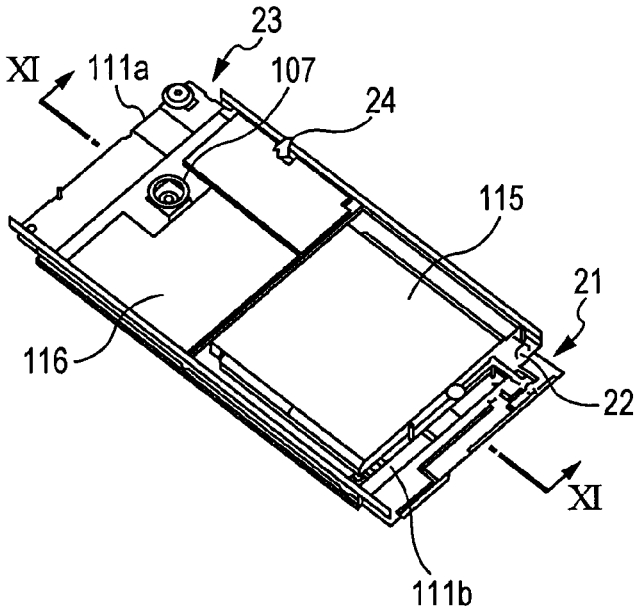
Figure 10C:
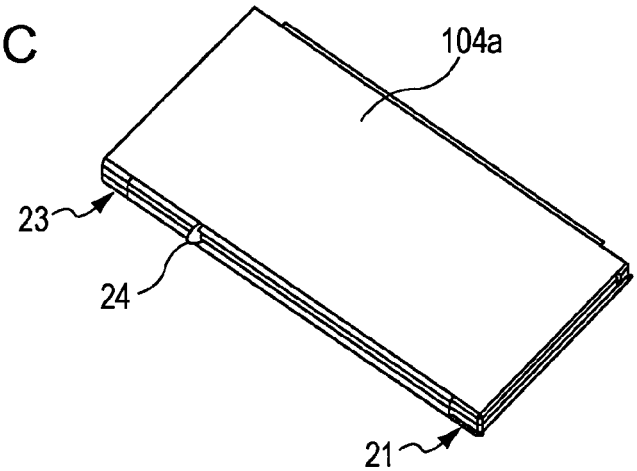

FIGS. 10(*a*) to 10(*c*) are perspective views schematically illustrating the appearance of the mobile terminal in the second aspect described above. FIG. 10(*a*) is a rear view of the mobile terminal, FIG. 10(*b*) is a rear view indicating the internal structure in which the case panel 106 on the rear has been removed, and FIG. 10(*c*) is a front view of the mobile terminal.

As described in FIG. 2, the mobile terminal, the outer shape of which is substantially a rectangular parallelepiped, has the antenna 21 at the bottom as the first antenna, and also has the antenna 23 at the top as the second antenna, which is a slit antenna. As seen from FIG. 10(*b*), the PCB 111*b*, an antenna element (feed element) constituting the antenna 21, and the feed point 22 for the antenna element are disposed at the bottom of the mobile terminal. A battery 115 is accommodated on the bottom side of the rear of the case panel 106. On the top side, various parts are placed on the PCB 111*a*. These parts are covered with shield cases 116 and 117. As illustrated in FIG. 10(*c*), the front surface of an LCD panel 104*a* is exposed on the front side of the mobile terminal.

Figure 11:
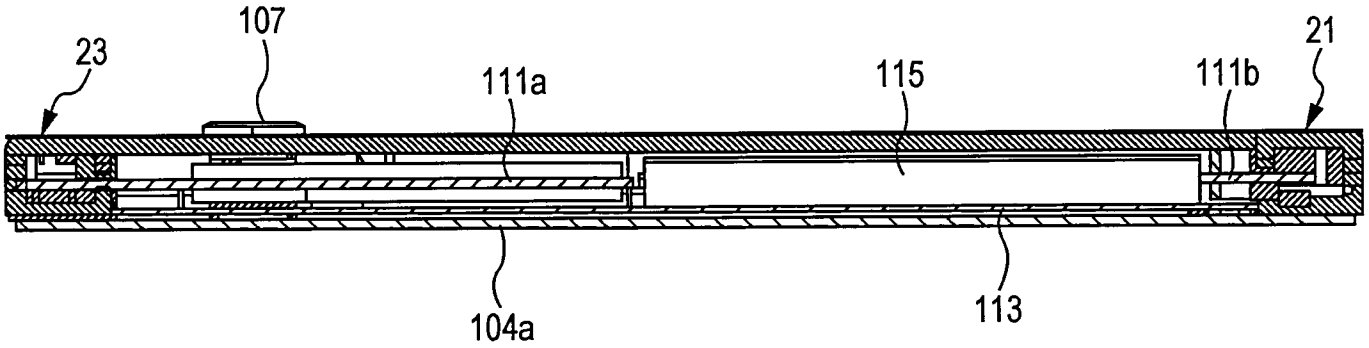
FIG. 11 is a cross sectional view illustrating section XI-XI taken along the central line extending in the longitudinal direction of the mobile terminal illustrated in FIG. 10(*b*).

FIG. 11 is a cross sectional view illustrating section XI-XI taken along the central line extending in the longitudinal direction of the mobile terminal illustrated in FIG. 10(*b*). As well illustrated in this drawing, the PCB 111*a* and PCB 111*b* are spaced apart, and the battery 115 is placed in the space therebetween.

Figure 12A:
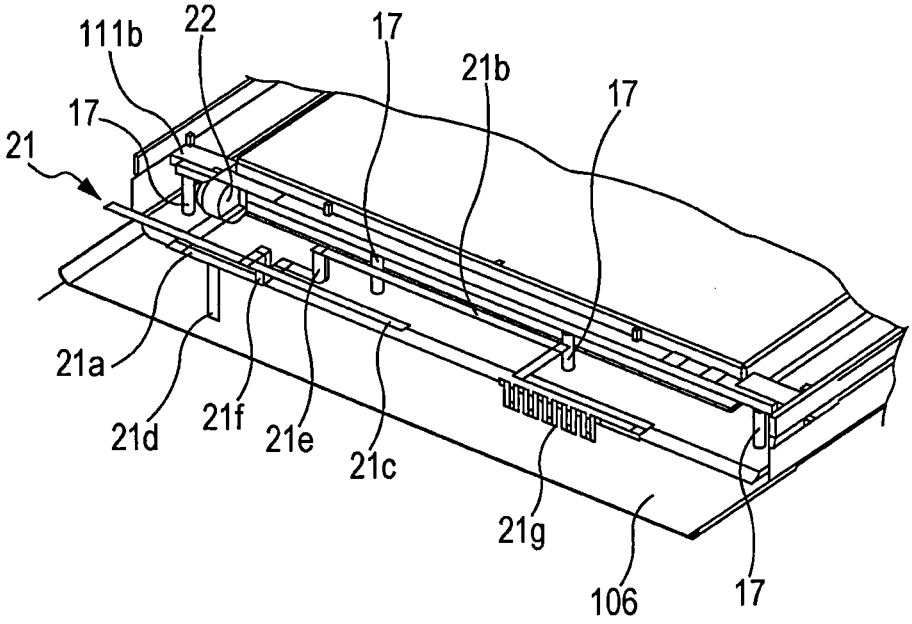
FIGS. 12(*a*) and 12(*b*) are enlarged perspective views, taken at different angles, of the antenna in the embodiment of the present invention.
Figure 12B:
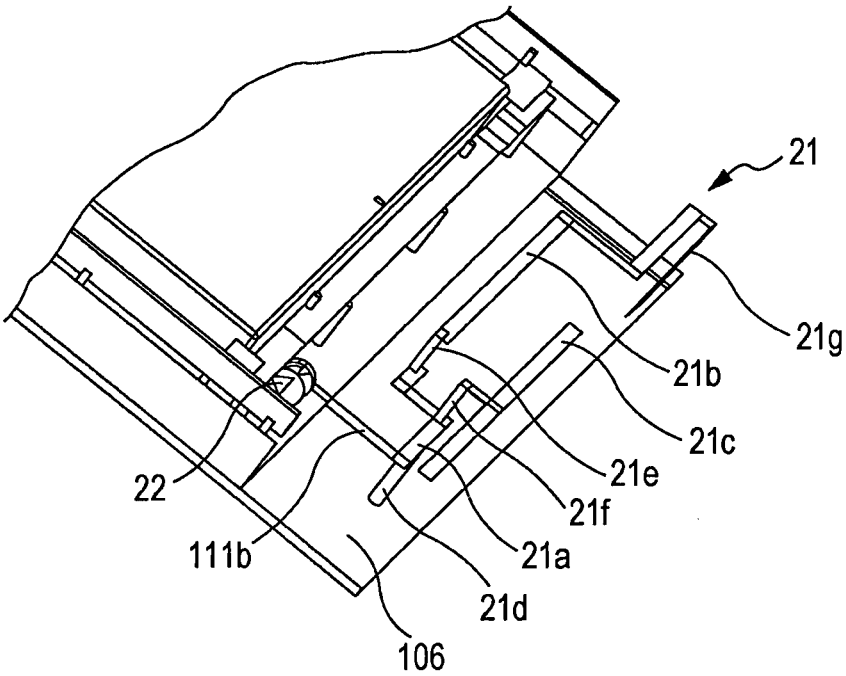

FIGS. 12(*a*) and 12(*b*) are enlarged perspective views, taken at different angles, of the antenna 21 in this embodiment.

An inverted-F type antenna is used as the antenna 21 in this embodiment. An inverted-F type antenna has an open end of a monopole antenna and a short-circuit point connected to ground at an intermediate position between the open end of the monopole antenna and the feed point. In the example in the drawing, a point on an antenna element 21*a*, which extends parallel to the plane of the PCB 111*b* from the feed point 22, is short-circuited to the case panel 106 through a GND pin 21*d*. A conductive pin 21*e* and a conductive pin 21*f* stand erect at the end of the antenna element 21*a* and a point at a little distance from the end toward the GND pin 21*d*, and antenna elements 21*b* and 21*c* extend from the two pins. In this example, the antenna element 21*b* has a meander part 21*g* on its free end side. In this example, the antenna 21 is a multi-band antenna; the antenna elements 21*b* and 21*c* are respectively a low-band antenna element and high-band antenna element. However, the antenna 21 may be single-band antenna. To obtain the antenna characteristics of the inverted-F type antenna, the conductive pin 21*e* and conductive pin 21*f* are used to separate the antenna elements 21*b* and 21*c* from the case panel 106 by a prescribed distance or more. These antenna elements can be formed by making a conductive pattern adhere to an insulative resin body. For the sake of convenience in indication on drawings, this type of resin body is omitted in FIGS. 12(*a*) and 12(*b*) and part of the PCB 111*b* is omitted.

The specific shape and structure of the antenna 21 in FIGS. 12(*a*) and 12(*b*) are indicated for illustrative purposes only; the antenna 21 is not limited to this type of shape and structure.

Figure 13A:
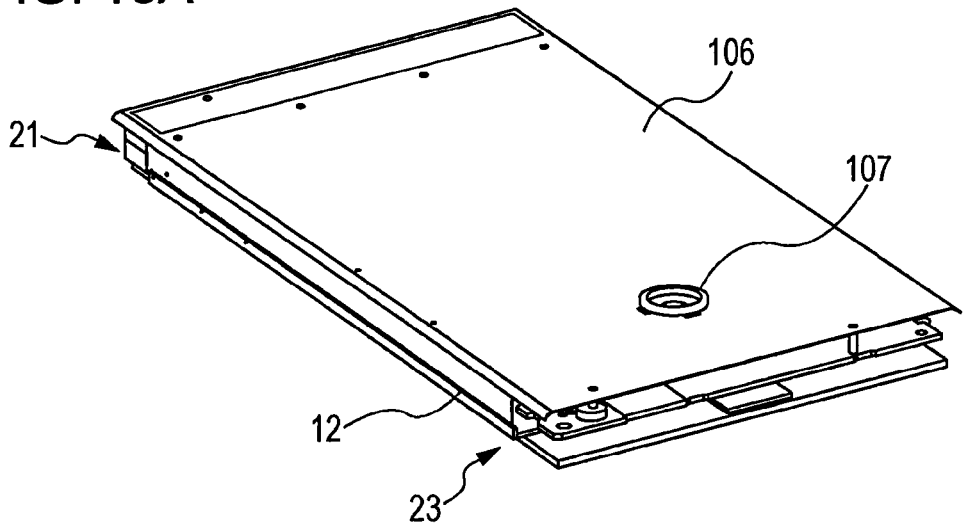
FIGS. 13(*a*) to 13(*c*) illustrates an example of the structure of the antenna in the embodiment of the present invention.
Figure 13B:
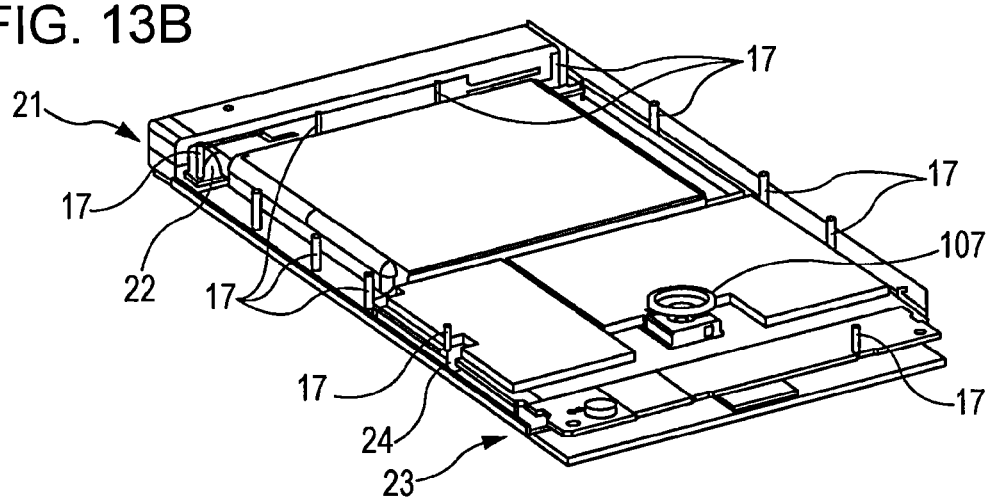
Figure 13C:
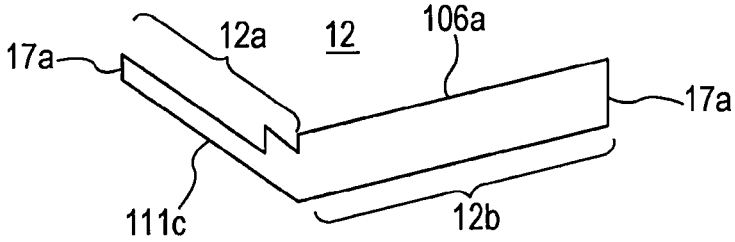

An exemplary structure of the antenna 23 in this embodiment will be described with reference to FIGS. 13(*a*), 13(*b*), and 13(*c*). FIG. 13(*a*) is a perspective view of the mobile terminal as viewed from the same side as the antenna 23. FIG. 13(*b*) illustrates the structure in which the case panel 106 has been removed from FIG. 13(*a*). FIG. 13(*c*) illustrates the outline of the slit 12 extracted from the perspective view of the mobile terminal in FIG. 13(*a*). In these drawings, the top of the mobile terminal is indicated on their lower side, as in FIG. 2.

As seen from FIGS. 13(*a*) and (*c*), the slit 12 extends not only along a side of the mobile terminal but also in a direction orthogonally bent from the longitudinal direction of the side. Therefore, its entire length varies depending on the position of the outermost short-circuiting members 17 of the batch of short-circuiting members 17. In the example in the drawing, the slit 12 has a side 12*a* and a top 12*b*, which communicates with it. The width of the slit 12 does not need to be uniform over its entire length. In this example, the width of the top 12*b* is larger than the width of the side 12*a*. The loop of edges that define the slit 12 is formed by edges 17*a* of the two outermost short-circuiting members 17 of the batch of short-circuiting members 17, an edge 106*a*, joined to the edges 17*a*, of the case panel 106 within a range in which there is no short-circuiting member 17, and an edge 111*c* of the conductive layer of the PCB facing the edge 106*a*.

Figure 14:
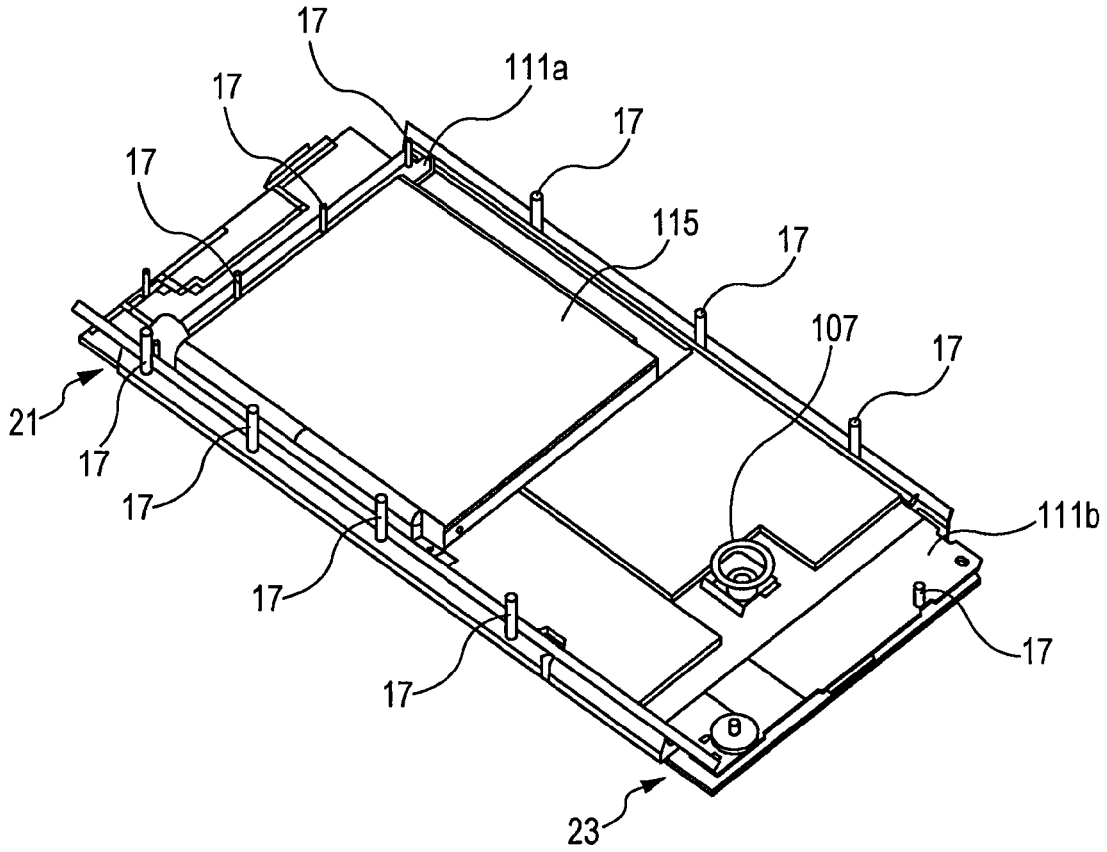
FIG. 14 is a perspective view on the rear surface side of the mobile terminal, in which the case panel 106 has been removed as in FIG. 13(*b*) to expose the internal antenna elements of an antenna 21.

FIG. 14 is a perspective view on the rear surface side of the mobile terminal, in which the case panel 106 has been removed as in FIG. 13(*b*) to expose the internal antenna elements of the antenna 21.

Figure 15A:
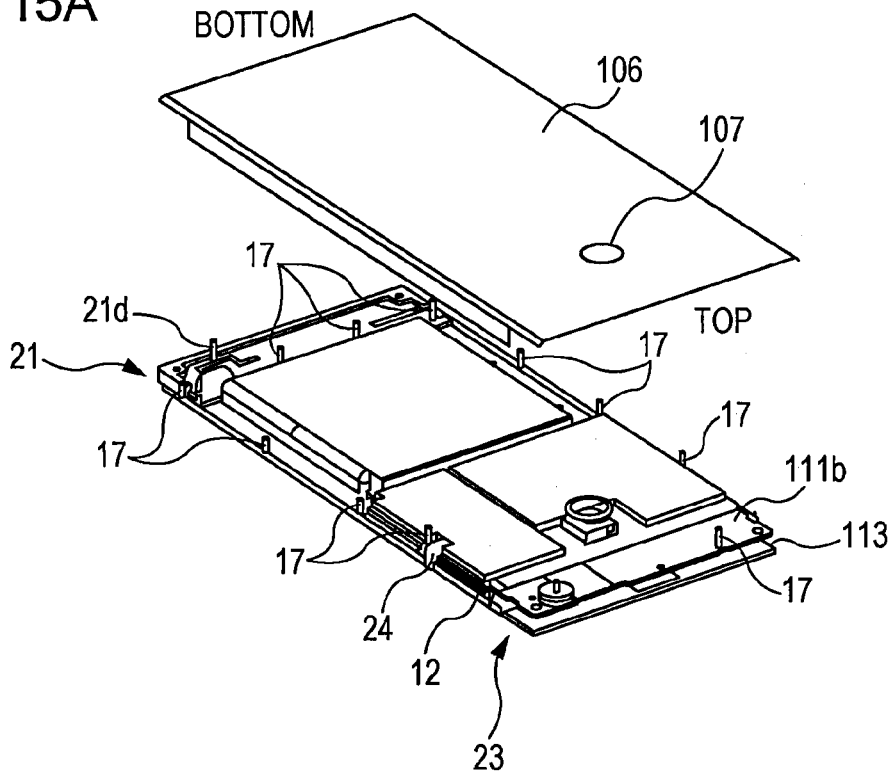
FIGS. 15(*a*) and 15(*b*) are perspective views illustrating specific examples of the structures of the mobile terminal that are applicable to the second and third aspects in FIGS. 13(*b*) and 13(*c*), respectively.
Figure 15B:
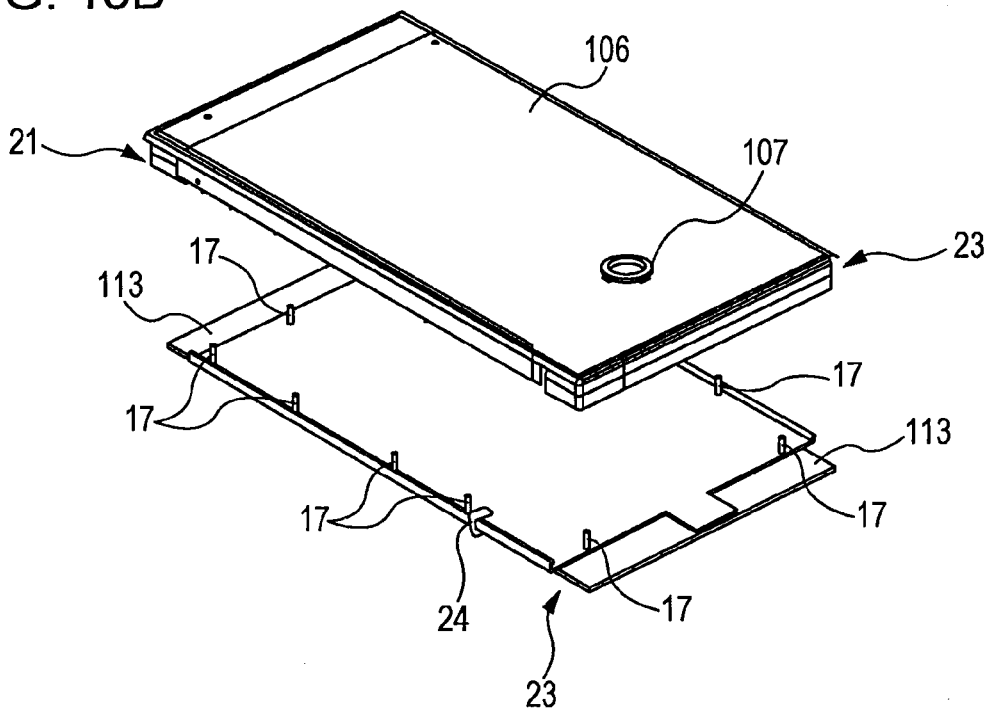

FIGS. 15(*a*) and 15(*b*) are perspective views illustrating specific examples of the structures of the mobile terminal that are respectively applicable to the second and third aspects in FIGS. 13(*b*) and 13(*c*), respectively.

With the slit antenna structured in the second aspect in FIG. 15(*a*), the slit 12 is formed between the case panel 106 and the PCB 111 (generic name of the PCBs 111*a* and 111*b*). In this example, the PCBs 111 and SUS plate 113 are grounded together. This type of integrated grounding can be carried out by mutually connecting the two conductive layers with a plurality of conductive pins 17 along the outer end of the SUS plate 113 at an interval shorter than the prescribed interval described above. The first aspect is not illustrated because it is self-evident from the second aspect.

With the slit antenna structured in the third aspect in FIG. 15(*b*), the slit 12 is formed between the case panel 106 and the SUS plate 113. In this example, the case panel 106 and the PCB 111 (including a combination of the PCBs 111*a* and 111*b*) are grounded together. This type of integrated grounding can be carried out by mutually connecting the two conductive layers with a plurality of conductive pins along the outer end of the case panel 106 at an interval shorter than the prescribed interval described above.

Figure 16:
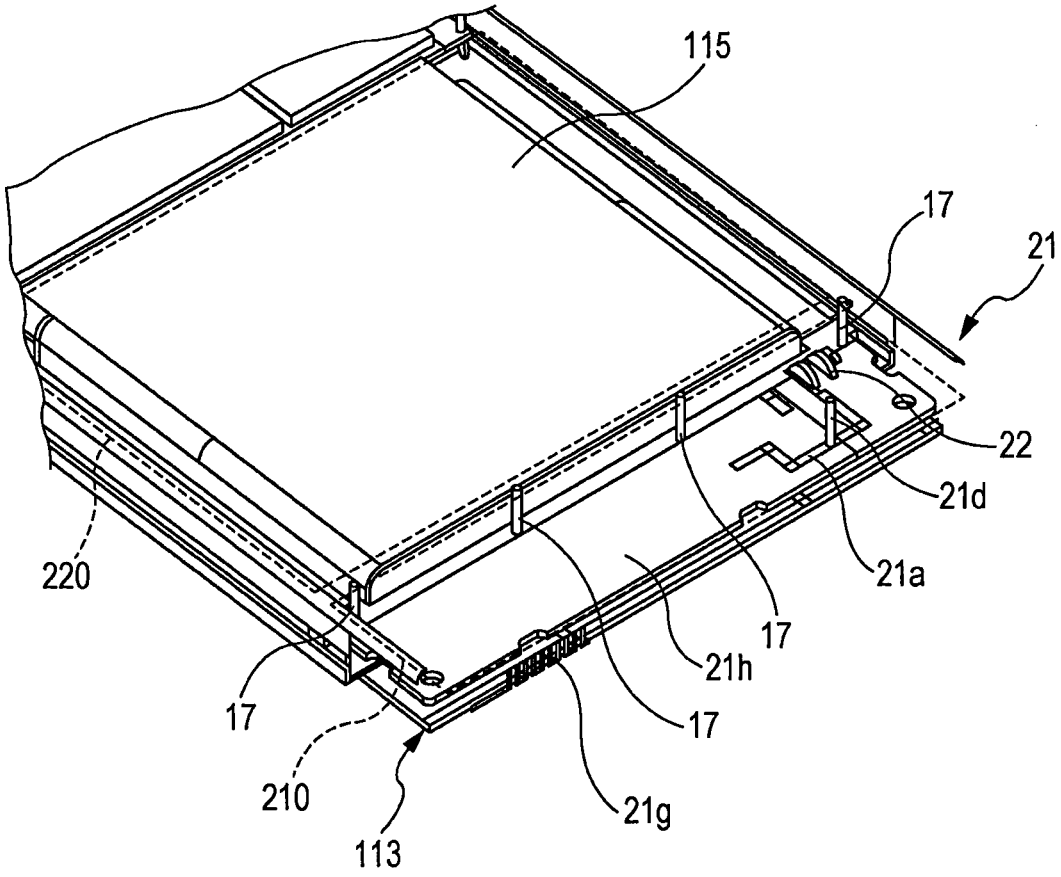
FIG. 16 is a drawing used to explain a boundary between an antenna area of the antenna on the bottom side of the mobile terminal and a battery area in which a battery has been placed.

FIG. 16 illustrates a boundary between an antenna area 210 of the antenna 21 on the bottom side of the mobile terminal and a battery area 220 in which the battery 115 has been placed. This drawing illustrates the antenna 21 at the bottom with the case panel 106 removed, as viewed from the rear side. This drawing indicates a state in which the antenna element 21*a* has been formed on the surface an insulative resin body 21*h*. Other antenna elements have been placed on the front side of another resin body not illustrated in FIG. 16.

As illustrated in FIGS. 5 and 12 as well, the conductive layers of the case panel 106 and PCB 111 (111*b*) are short-circuited with a plurality of short-circuiting members 17 (four conductive pins in the example in the drawing). The PCB 111 and SUS plate 113 are also short-circuited with GND pins (hidden in FIG. 16). This structure prevents the conductive case panel 106 and the like from adversely affecting the antenna characteristics of the antenna 21.

Figure 17A:
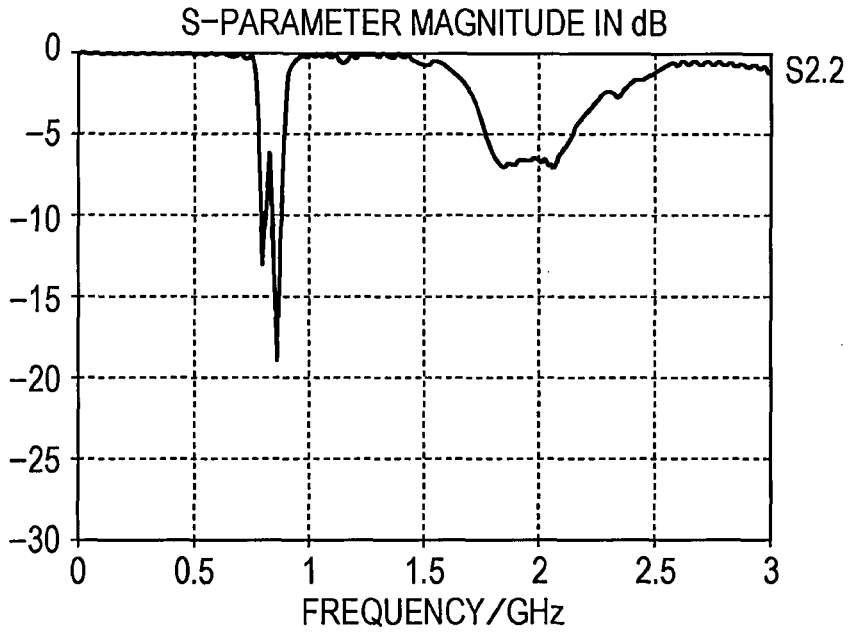
FIGS. 17(*a*) and 17(*b*) each are a graph representing the frequency characteristics (return loss) of the bottom-side antenna when there are short-circuiting members on the boundary between the antenna area and the battery area and when there is no short-circuiting member.
Figure 17B:
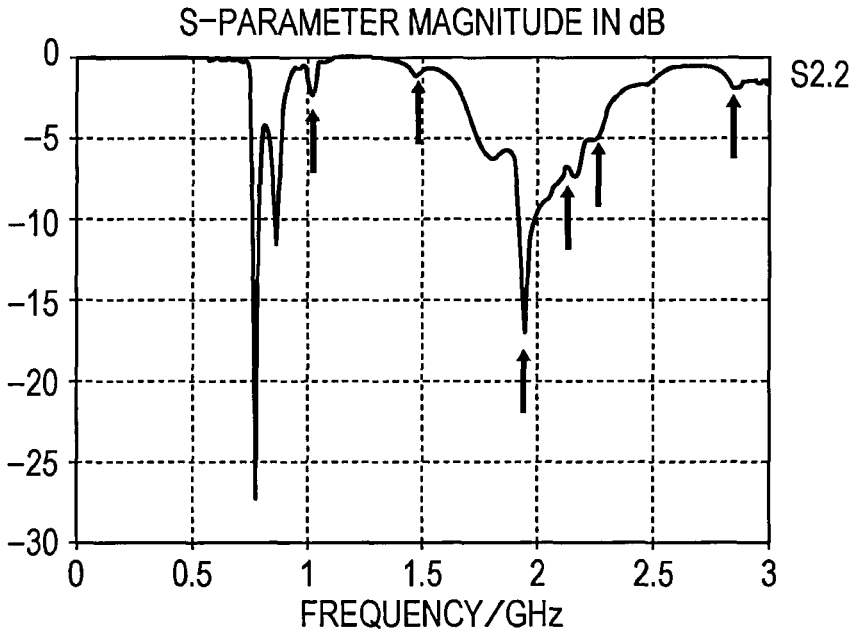

FIGS. 17(*a*) and 17(*b*) each are a graph representing the frequency characteristics (return loss) of the antenna 21 when there are short-circuiting members 17 on the boundary between the antenna area 210 and the battery area 220 and when there is no short-circuiting member 17. As seen from the two graphs, when there is no short-circuiting member 17 on the boundary, spurious emissions appear in the antenna characteristics as indicated by the arrows in FIG. 17(*b*) and the antenna efficiency is lowered. By contrast, when there are short-circuiting members 17 on the boundary, these spurious emissions are suppressed as illustrated in FIG. 17(*a*), the antenna efficiency is improved.

Figure 18A:
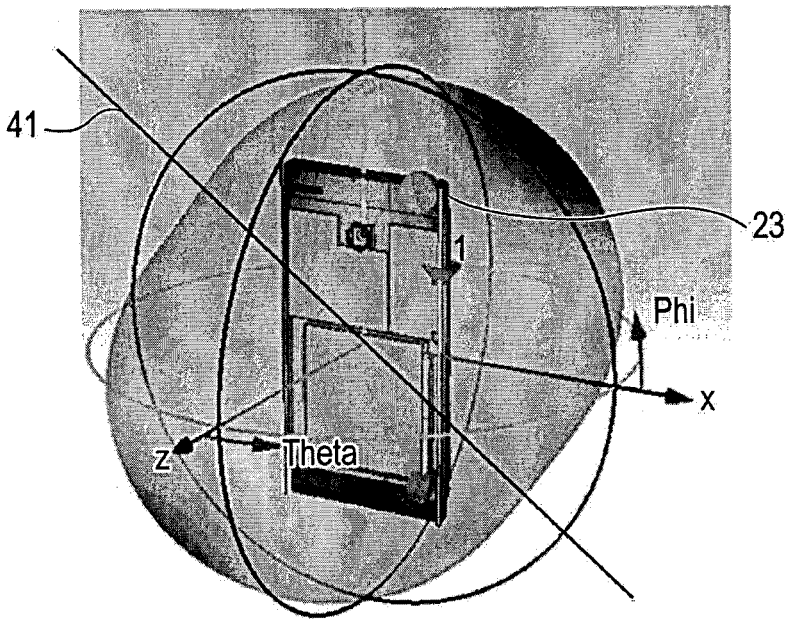
FIGS. 18(*a*) and 18(*b*) illustrate radiation patterns viewed from the front of the mobile terminal when the second antenna, which is the antenna on the top side, and the second antenna, which is the first antenna on the bottom side, are separately powered at a prescribed frequency in relatively low frequencies (low band).
Figure 18B:
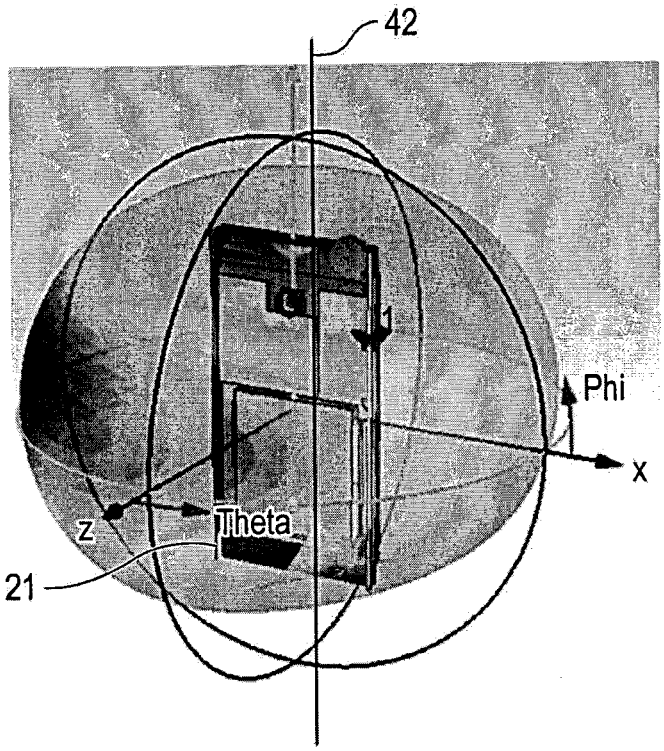

FIGS. 18(*a*) and 18(*b*) illustrate radiation patterns viewed from the front of the mobile terminal when the second antenna 23, which is the antenna on the top side, and the second antenna 21, which is the first antenna on the bottom side, are separately powered at a prescribed frequency in relatively low frequencies (low band). These radiation patterns are three-dimensionally doughnut-shaped. It is known that the central axis 41 of the radiation pattern of the antenna 23 and the central axis 42 of the radiation pattern of the antenna 21 are angled with respect to each other. This means that the correlation between the two antennas is low.

Figure 19:
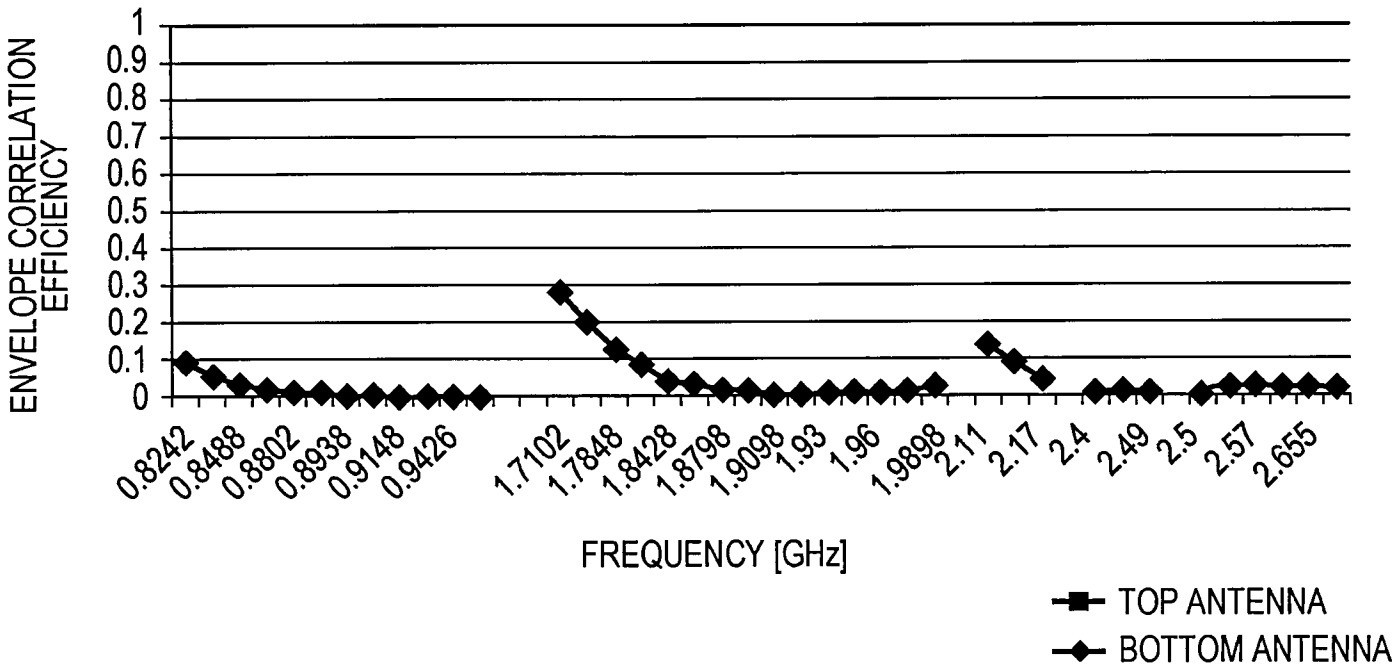
FIG. 19 is a graph representing values of the correlation coefficient between the first antenna and the second antenna, which are results obtained at a plurality of frequencies.

FIG. 19 is a graph representing values of the correlation coefficient between the first antenna 21 and the second antenna 23, which are results obtained at a plurality of frequencies. As seen from this drawing, the correlation is low even in the low band. Although the low band in this drawing is indicated only down to 0.8242 GHz, an adequately low correlation can be achieved down to a lower band by antenna adjustment. For example, antenna adjustment is possible down to the 700 MHz band by increasing the electric lengths of low-band antenna elements in the case of the first antenna or by increasing the slit length or the capacity of the capacitor 25 (FIG. 5) in the case of the second antenna.

In the embodiment of the present invention, a wireless communication device is described that has a first antenna having a first feed point, and a second antenna 23 having a second feed point, the second antenna being spaced apart from the first antenna;

the first antenna is an antenna having a feed element, the second antenna is a slit antenna, and the slit antenna has a first conductive plate, a second conductive plate disposed substantially parallel to the first conductive plate, and a short-circuiting member that electrically creates a short-circuit between the first conductive plate and the second conductive plate so that a prescribed slit is formed by part of the outer end of the first conductive plate and part of the outer end of the second conductive plate, the part of the outer end of the first conductive plate and the part of the outer end of the second conductive plate facing each other.

With this wireless communication device, it is also described that the first conductive plate is a case panel having conductivity, and the second conductive plate is a conductive layer formed on a printed circuit board.

With this wireless communication device described above, it is also described that the first conductive plate is a case panel having conductivity, and the second conductive plate is a metal plate placed substantially parallel to the case panel.

With any of the wireless communication devices described above, it is also described that the short-circuiting member is a plurality of conductive contact members.

With this wireless communication device, it is also described that the plurality of conductive contact members are placed at intervals smaller than a prescribed interval along the outer ends of the first and second conductive plates outside the area of the slit.

With the wireless communication device described above, it is also described that the short-circuiting member is formed as a conductive plate-like member placed between the first and second conductive plates along the outer ends outside the area of the slit.

With any of the wireless communication devices described above, it is also described that the first antenna is an inverted-F type antenna, which has another short-circuiting member that electrically short-circuits a position on the feed element spaced apart from the first feed point to the first conductive plate.

With any of the wireless communication devices described above, it is also described that the first and second antennas constitute a MIMO antenna device.

Although a preferred embodiment of the present invention has been described, various variations and modifications can be made besides the above descriptions. That is, it will be understood by those skilled in the art that various modification and combinations and other embodiments may be derived from design or other elements within the range of the claims or an equivalent range of the claims.

Although, for example, the inverted-F type antenna has been taken as an example of the first antenna, the first antenna is not limited to the inverted-F type antenna; an antenna that differs from the slit antenna in the principle of operation can be used.

Although an example in which the case panel 106 encloses the entire rear surface of the case has been indicated, it does not necessarily enclose the entire rear surface.

Although a so-called straight wireless communication device has been described as an example, the present invention can also be applied to wireless communication devices in other forms such as folding wireless communication devices and slide wireless communication devices.

[Reference Signs List]

10: conductor plate
11: conductive plate
12: slit
12*a*: side
12*b*: top
13: conductive plate
15: element
16: conductive plate
17: short-circuiting member
17*a*: edge
18: range
19: range
21: first antenna
21*a*: antenna element
21*b*: antenna element
21*d*: GND pin
21*e*: conductive pin
21*f*: conductive pin
21*h*: resin body
22: feed point
23: second antenna
24: feed point
25: element
41: central axis
42: central axis
101: case
102: speaker part
103: conductive plate
104: display screen
104*a*: LCD panel
105: manipulation part
105*a*: manipulation key
106: case panel
106*a*: edge
107: camera part
111, 111*a*, 111*b*: printed circuit board (PCB)
111*c*: edge
112: conductive linking member
113: SUS plate
115: battery
116: shield case
117: shield case
210: antenna area
220: battery area

The invention claimed is:

1. A communication terminal apparatus comprising:

a first antenna having a first feed point, the first antenna disposed on one end of the communication terminal apparatus; and a second antenna including a slit antenna and having a second feed point, the second antenna disposed at least at an opposite end of the communication terminal apparatus so as to be spaced apart from the first antenna, wherein the slit antenna includes a first conductive plate, a second conductive plate disposed substantially parallel to the first conductive plate, and a short-circuiting structure electrically connected between the first conductive plate and the second conductive plate so as to electrically short the first conductive plate to the second conductive plate and form a slit having a perimeter defined by a portion of the first conductive plate, a portion of the second conductive plate and the short-circuitry structure.

2. The communication terminal apparatus of claim 1, wherein the slit antenna is formed by part of an outer end of the first conductive plate and part of an outer end of the second conductive plate, the part of the outer end of the first conductive plate and the part of the outer end of the second conductive plate face each other.

3. The communication terminal apparatus of claim 1, wherein:

the first conductive plate is part of a conductive case panel.

4. The communication terminal apparatus of claim 3, wherein:

the second conductive plate is a conductive layer of a printed circuit board.

5. The communication terminal apparatus of claim 3, wherein:

the second conductive plate is a metal plate that is positioned substantially parallel to the first conductive plate of the case panel.

6. The communication terminal apparatus of claim 1, wherein:

the short circuiting structure includes a plurality of conductive contact members.

7. The communication terminal apparatus of claim 6, wherein the plurality of conductive contact members are disposed between the first conductive plate and the second conductive plate and spaced outside a slit portion of the slit antenna and at intervals smaller than a predetermined interval along respective outer ends of the first conductive plate and the second conductive plates, said predetermined interval being set so that a resonance frequency of the slit antenna is higher than a communications frequency used by said communications terminal apparatus.

8. The communication terminal apparatus of claim 1, wherein the first antenna is an inverted F-type antenna that includes a feed element and a short- circuiting member that electrically shorts a position on the feed element spaced apart from the first feed point to the first conductive plate.

9. The communication terminal apparatus of claim 1, wherein the first antenna and the second antenna are parts of a MIMO antenna device.

10. A wireless communications device comprising:

a display screen ; and a MIMO antenna device; and a case that houses said display screen and MIMO antenna device, said MIMO antenna device including a first antenna having a first feed point, the first antenna disposed on one end of the communication terminal apparatus; and a second antenna including a slit antenna and having a second feed point, the second antenna disposed at least at an opposite end of the communication terminal apparatus so as to be spaced apart from the first antenna, wherein the slit antenna includes a first conductive plate, a second conductive plate disposed substantially parallel to the first conductive plate, and a short-circuiting structure electrically connected between the first conductive plate and the second conductive plate so as to electrically short the first conductive plate to the second conductive plate and form a slit having a perimeter defined by a portion of the first conductive plate, a portion of the second conductive plate and the short-circuitry structure.

11. The wireless communications device of claim 10, wherein the slit antenna is formed by part of an outer end of the first conductive plate and part of an outer end of the second conductive plate, the part of the outer end of the first conductive plate and the part of the outer end of the second conductive plate face each other.

12. The wireless communications device of claim 10, wherein the first conductive plate is part of a conductive case panel.

13. The wireless communications device of claim 12, wherein the second conductive plate is a conductive layer of a printed circuit board.

14. The wireless communications device of claim 12, wherein the second conductive plate is a metal plate that is positioned substantially parallel to the first conductive plate of the case panel.

15. The wireless communications device of claim 10, wherein the short circuiting structure includes a plurality of conductive contact members.

16. The wireless communications device of claim 15, wherein the plurality of conductive contact members are disposed between the first conductive plate and the second conductive plate and spaced outside a slit portion of the slit antenna and at intervals smaller than a predetermined interval along respective outer ends of the first conductive plate and the second conductive plates, said predetermined interval being set so that a resonance frequency of the slit antenna is higher than a communications frequency used by said communications terminal apparatus.

17. The wireless communications device of claim 10, wherein the first antenna is an inverted F-type antenna that includes a feed element and a short-circuiting member that electrically shorts a position on the feed element spaced apart from the first feed point to the first conductive plate.

* * * * *